US005159347A

United States Patent [19]

Osterwalder

[11] Patent Number: 5,159,347

[45] Date of Patent: Oct. 27, 1992

[54] MICROMAGNETIC CIRCUIT

[75] Inventor: Jean-Pierre F. Osterwalder, Vienna, Va.

[73] Assignee: E-Systems, Inc., Dallas, Tex.

[21] Appl. No.: 436,077

[22] Filed: Nov. 14, 1989

[51] Int. Cl.[5] ..... H01Q 1/00

[52] U.S. Cl. ..... 343/787; 336/177; 324/219

[58] Field of Search ..... 343/787, 866, 867, 788, 343/793; 336/177; 324/219

[56] References Cited

U.S. PATENT DOCUMENTS

| | | | |
|---|---|---|---|
| 3,007,165 | 10/1961 | Engelbrecht | 343/787 |
| 3,016,535 | 1/1962 | Hewitt, Jr. | 343/787 |
| 3,233,587 | 2/1966 | Morton | 336/177 |
| 3,911,380 | 10/1975 | Lavedan, Jr. | 333/24.1 |
| 3,943,391 | 3/1976 | Fehr | 336/177 |
| 4,622,542 | 11/1986 | Weaver | 340/551 |
| 4,779,076 | 10/1988 | Weaver | 340/572 |
| 4,947,179 | 8/1990 | Ganter et al. | 343/718 |

FOREIGN PATENT DOCUMENTS

| | | | |
|---|---|---|---|
| 1-270208 | 10/1989 | Japan | 336/177 |

*Primary Examiner*—Michael C. Wimer
*Assistant Examiner*—Hoanganh Le
*Attorney, Agent, or Firm*—Rogers & Killeen

[57] ABSTRACT

Microscopic strips of high permeability magnetic conductor are arrayed in a proximate relation to an electrical conductor to form paths for magnetic circuits about the electrical conductor. The strips may take various forms including filaments, such as one hundred micron microwire, and deposited submicron-sized layers of amorphorous magnetic material. The magnetic circuits may be closed with the strips forming a plurality of bands around the electrical conductor, and the magnetic circuits may be open, such as with the strips arrayed linearly adjacent to the electrical conductor. The magnetic circuits have numerous applications, including a variety of antennas, inductive wires, antenna ground planes, inductive surfaces, magnetic sensors, and direction finding arrays.

83 Claims, 5 Drawing Sheets

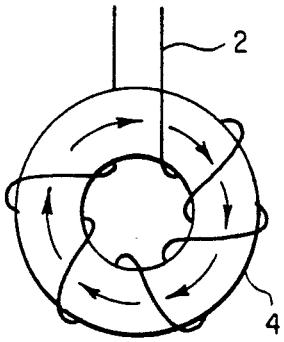
FIG. 1
(PRIOR ART)
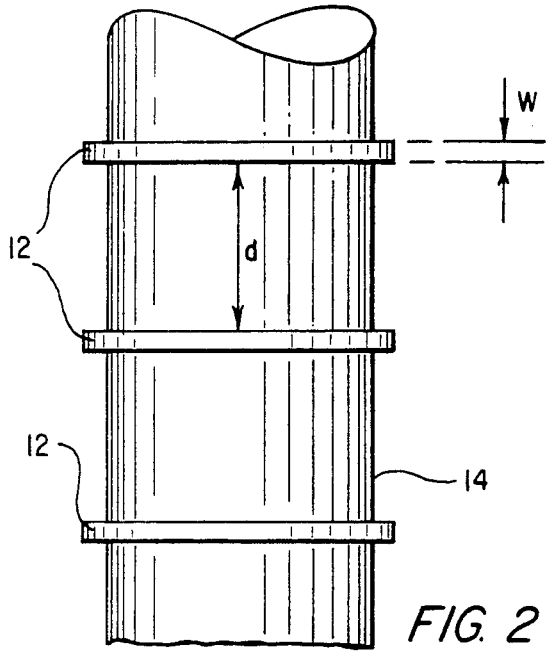
FIG. 2
FIG. 3
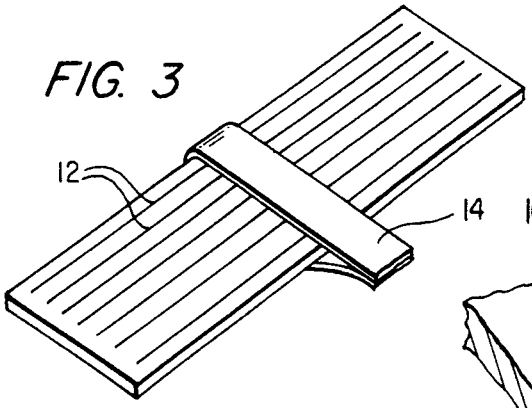
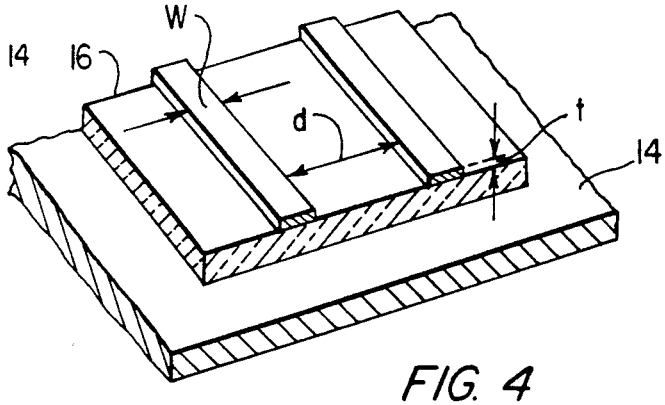
FIG. 4
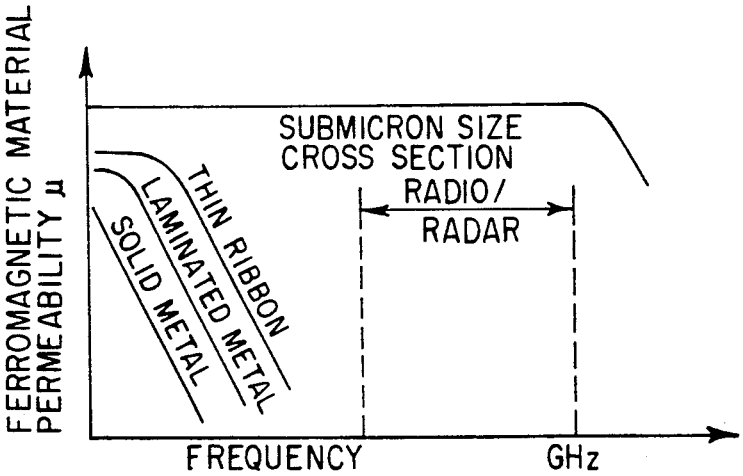
FIG. 5
FREQUENCY RESPONSES OF VARIOUS
CROSS SECTIONAL SIZES OF FERROMAGNETIC MATERIAL FIG. 8 B
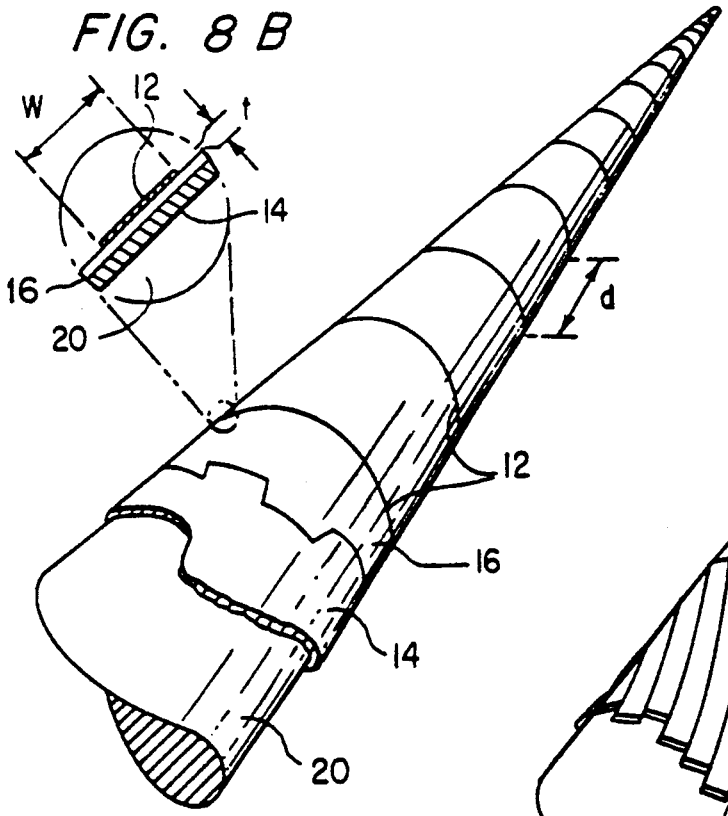
FIG. 8A
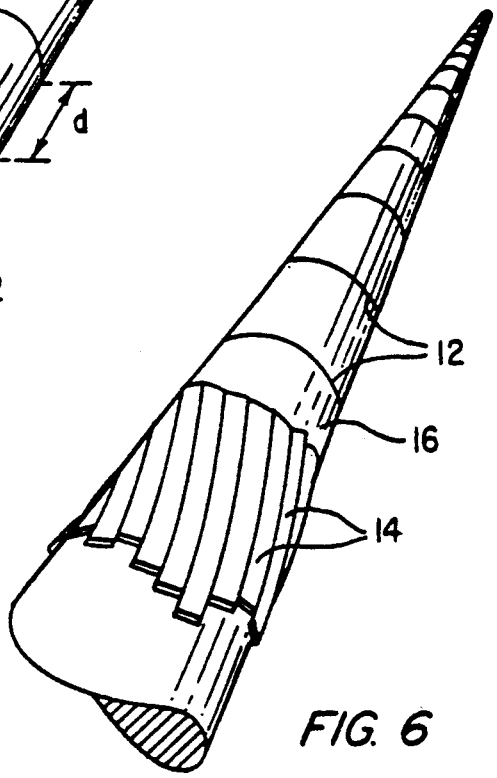
FIG. 6
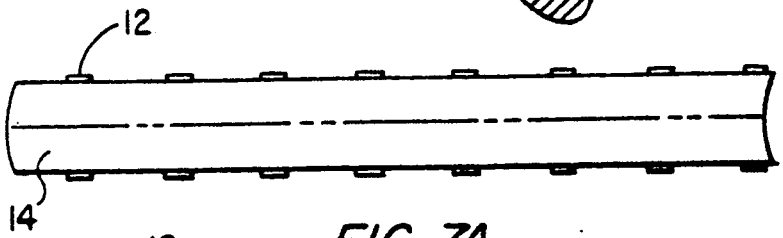
FIG. 7A
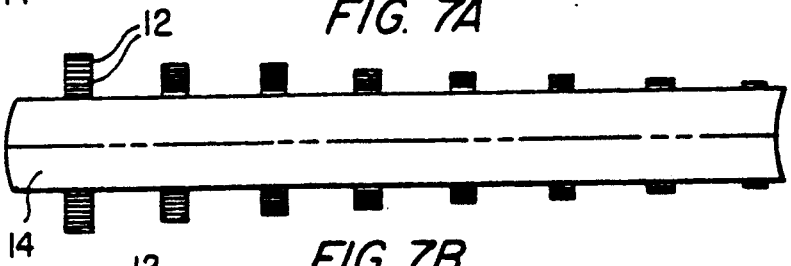
FIG. 7B
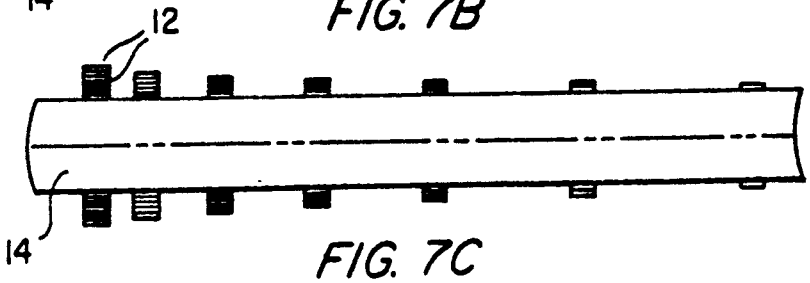
FIG. 7C

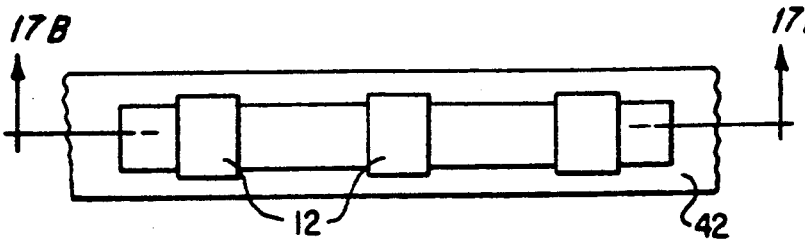
FIG. 17A
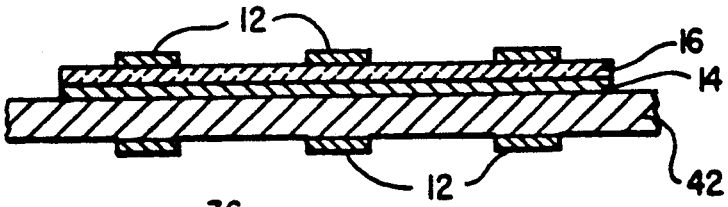
FIG. 17B
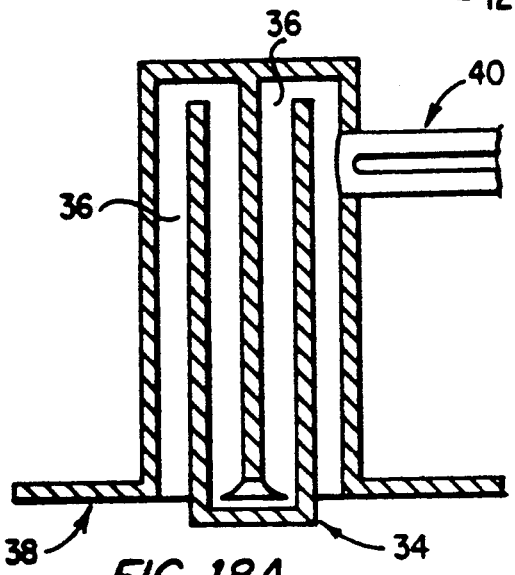
FIG. 18A
(PRIOR ART)
FIG. 18B
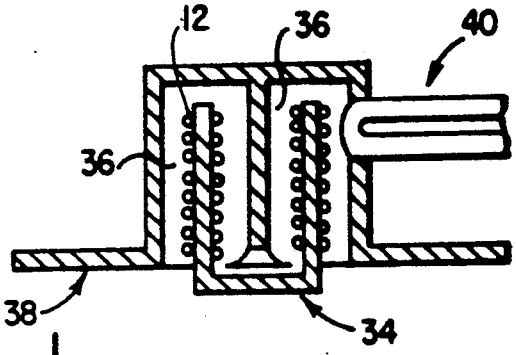
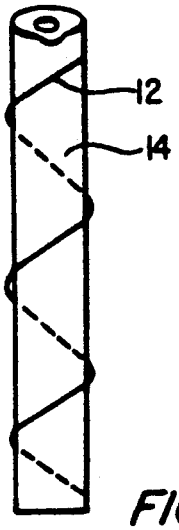
FIG. 19
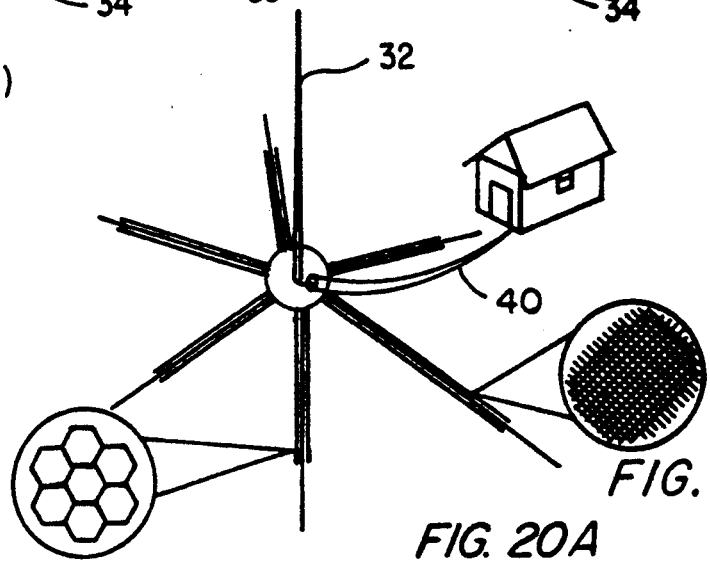
FIG. 20C
FIG. 20A
FIG. 20D

MICROMAGNETIC CIRCUIT

BACKGROUND OF THE INVENTION

The present invention relates to micromagnetic circuits. More particularly, it relates to magnetic circuits in which a miniaturized magnetic conductor is disposed in the proximity of an electrical conductor for forming a magnetic path for a magnetic field related to the one produced by the electrical conductor.

Comprehension of the present invention will be enhanced by a description of the terms used herein. A magnetic field can be represented by lines called lines of induction. Lines of induction generally follow a path of least resistance (e.g., through higher permeability material) around the conductor producing the magnetic field. A line of induction closes on itself, not at a terminal as in an electric field. The region occupied by the lines of induction is called a magnetic circuit.

To create a path for the magnetic circuit, it has long been known to position a magnetic conductor in the magnetic field created by a coiled electrical wire. This technique is seen in traditional electromagnetic devices such as inductors and transformers.

For example, in the well-known toroidal ring seen in FIG. 1, an electrical conductor 2 is wrapped around a magnetic conductor 4 having a higher permeability than the air around it. When the electrical conductor is closely wound and an electrical current passed therethrough, practically all of the lines of induction are confined to the magnetic conductor ring 4, thereby creating the magnetic circuit indicated by the arrows inside the ring.

It is also known that the size of the magnetic conductor itself causes eddy current and hysteresis loses in the magnetic conductor. Techniques to reduce these losses have focused on improvements to the traditional magnetic devices such as partitioning the magnetic conductor and choosing magnetic conductor material having a higher permeability and higher electrical resistance.

The present invention completely revolutionizes these known techniques. Briefly, the magnetic conductor is now arrayed in strips about the electrical conductor to form paths for the magnetic field. The magnetic conductor forming the path may include amorphous material having very high permeability, low magnetic reluctance, and relatively high electrical resistance. Moreover, because the path for the magnetic circuit may be thousands of times more inviting for the lines of induction than the ambient air, only a microscopic strip of the magnetic conductor material may be needed. (A "microscopic strip" has a microscopic sized cross-sectional area and a length appropriate for the specific application.) For example, as seen in FIGS. 2 and 3, one or more strips 12 of high permeability magnetic conductor may be disposed in a proximate relation to an electrical conductor 14. The strips 12 may have any cross-sectional shape, such as a rectangle or a circle, and may range in cross-sectional size from several Angstroms thick (t) and several thousand Angstroms wide (w) to much larger dimensions in diameter. Each strip may be, for example, a deposited layer (i.e., a "painted" strip) or a small filament such as microwire.

The magnetic circuit of the present invention may take numerous forms and have countless applications. In its simplest embodiments, it may take two general forms; a closed circuit in which the strips generally form bands around the electrical conductor (see, for example, FIG. 2), and an open circuit in which the strips are arrayed linearly adjacent the electrical conductor (FIG. 3). The closed circuit form creates a closed path for a magnetic field and may be used to make electrical conductors more inductive in, for example, inductive wires, a variety of antennas, antenna ground planes, and inductive surfaces. In its open circuit form the present invention collects a portion of an existing magnetic field (i.e., by providing a high permeability path) and may be used in, for example, magnetic sensors and direction finding antennas. In either form, the circuit of the present invention is particularly useful for miniaturizing traditional inductive devices such as antennas and inductors. Further, the permeability of the microscopic strips is relatively insensitive to frequency variation and thus the present invention is particularly suited for antennas covering a wide range of frequencies. Smaller cross-sections may be appropriate when the present invention is to operate at relatively low power with frequencies up to several gigahertz. Larger cross-sections may be appropriate when the present invention is to operate with relatively high power at lower frequencies (e.g., a kilohertz).

Accordingly, it is an object of the present invention to provide a magnetic circuit that obviates the problems of the prior art and that provides a microinductive device for countless applications.

It is yet another object of the present invention to provide a magnetic circuit that creates microscopic paths for a magnetic field around an electrical conductor.

It is still another object of the present invention to provide a magnetic circuit that provides microscopic paths for electromagnetic waves.

It is a further object of the present invention to provide a miniaturized antenna that is responsive to electromagnetic waves having a wide band of frequencies.

It is still a further object of the present invention to provide an antenna with micromagnetic conductors for establishing the inductivity of the antenna along the length of the antenna.

It is a yet a further object of the present invention to provide a novel method for increasing the inductivity of a wire.

These and many other objects and advantages will be readily apparent to one skilled in the art to which the invention pertains from a perusal of the claims, the appended drawings, and the following detailed description of preferred embodiments.

THE DRAWINGS

FIG. 1 is a pictorial representation of a toroidal ring of the prior art.

FIG. 2 is a pictorial representation of an embodiment of the present invention in its closed circuit form with bands of magnetic conductor disposed about an electrical conductor.

FIG. 3 is a further embodiment of the present invention in its open circuit form with microscopic strips of magnetic conductor disposed adjacent an electrical conductor.

FIG. 4 is a partial pictorial representation of an embodiment of the present invention.

FIG. 5 is a chart showing the frequency responses of ferromagnetic materials having various cross-sectional sizes.

FIG. 6 is a partial pictorial representation of an embodiment of the present invention with a multistranded electrical conductor.

FIGS. 7A-C are partial pictorial representations of embodiments of the present invention in cross-section showing stacking techniques for the magnetic conductor strips.

FIG. 8 is a partial pictorial representation of an embodiment of a monopole antenna of the present invention.

Figure 9:
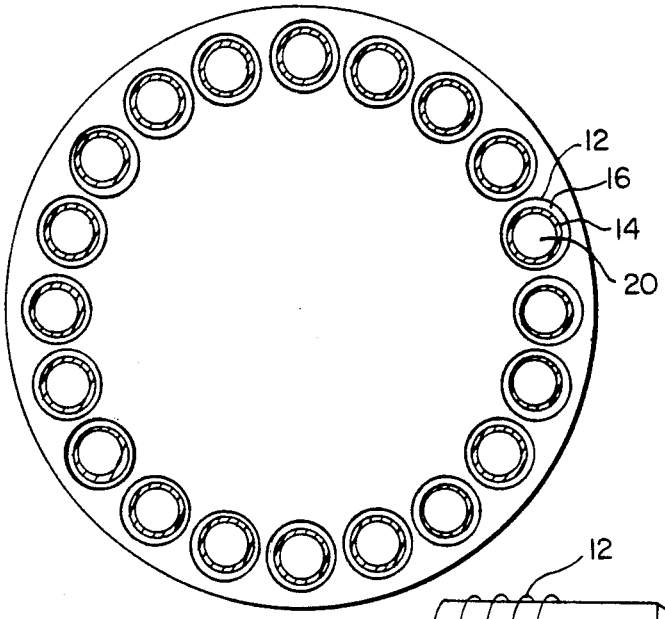

FIG. 9 is a cross-sectional view of a multistranded cable antenna using plural antennas.

Figure 10:
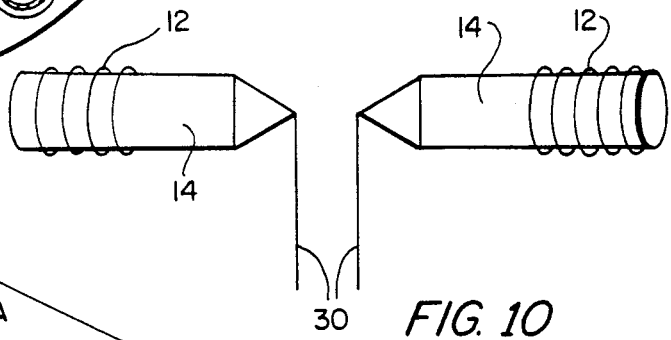

FIG. 10 is a partial pictorial representation of a dipole antenna of the present invention.

Figure 11:
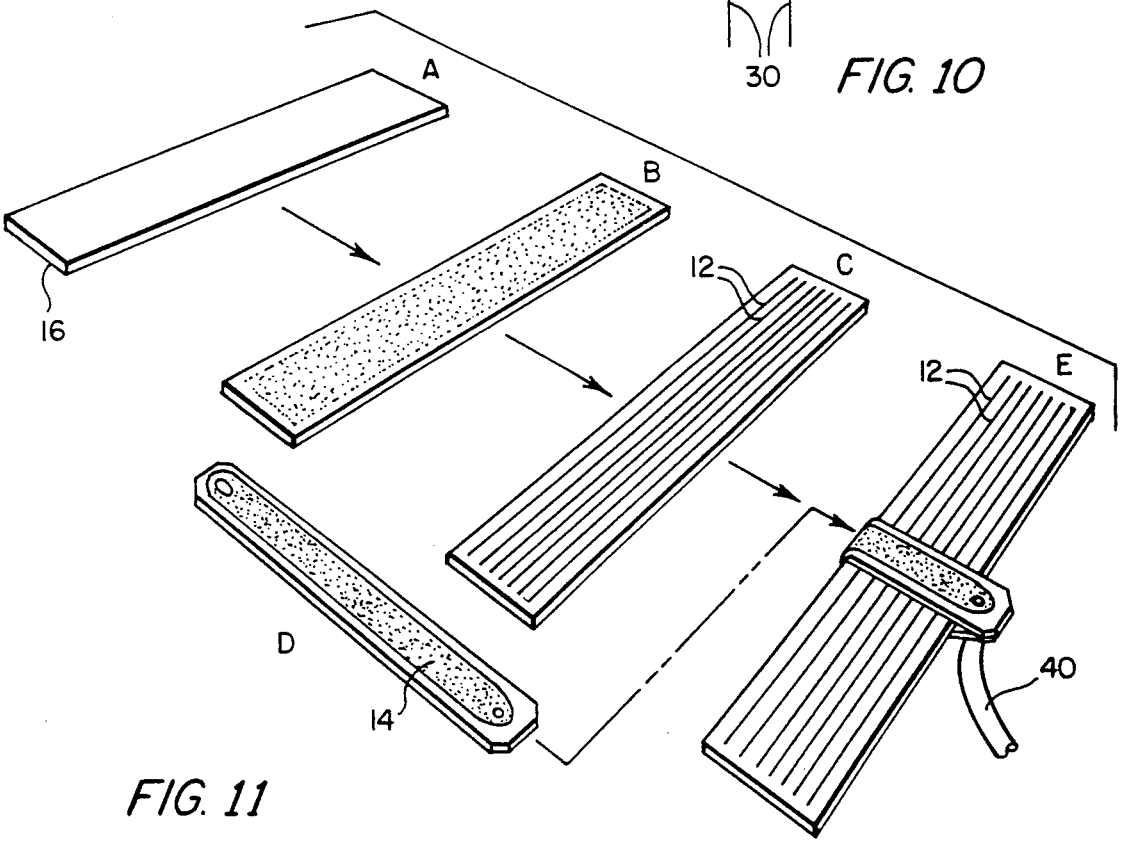

FIG. 11 depicts the steps for forming a single loop antenna having an open magnetic circuit of the present invention.

Figure 12:
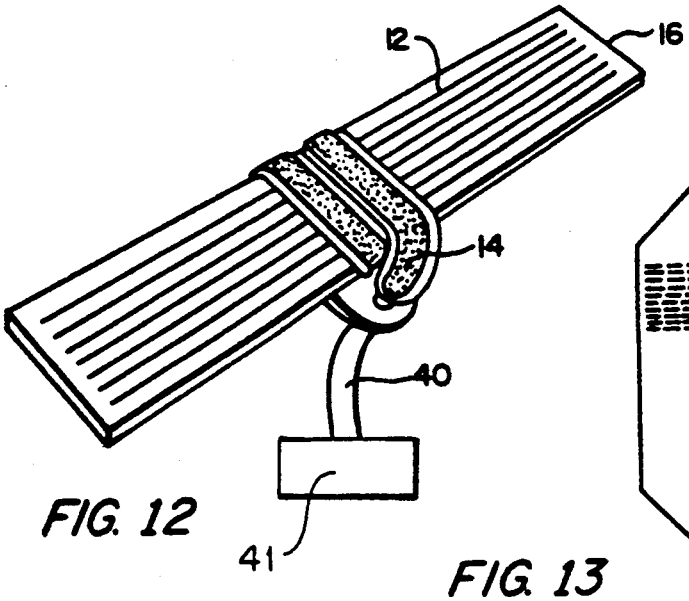

FIG. 12 is a multi-turn loop antenna of the present invention that may be formed using the steps depicted in FIG. 11.

Figure 13:
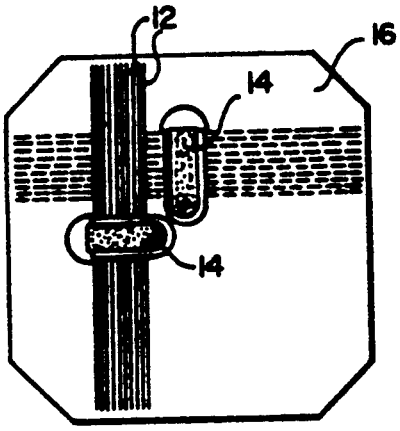

FIG. 13 is a twin loop antenna of the present invention that may be formed using the steps depicted in FIG. 11.

Figure 14:
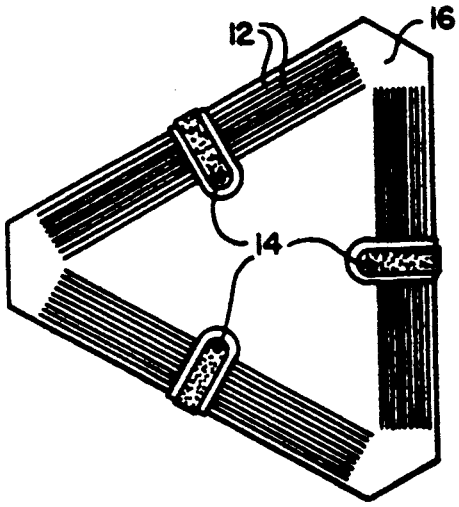

FIG. 14 is a three loop antenna of the present invention that may be formed using the steps depicted in FIG. 11.

Figure 15:
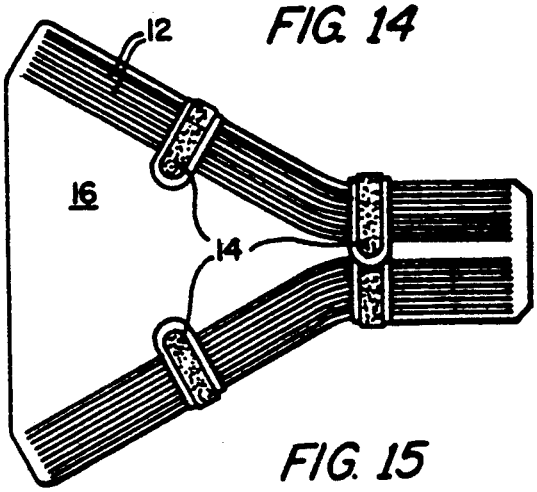

FIG. 15 is a direction finding antenna of the present invention that may be formed using the steps depicted in FIG. 11.

Figure 16:
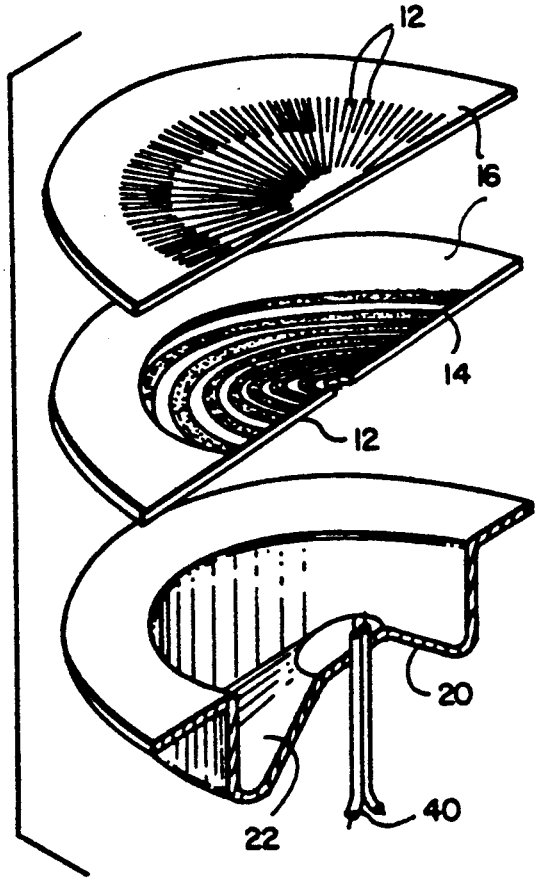

FIG. 16 is an exploded partial pictorial representation of a spiral antenna of the present invention shown in cross-section.

FIG. 17A is a top pictorial view of printed circuit board embodying the present invention.

FIG. 17B is a cross-sectional view of the embodiment of FIG. 17A.

FIG. 18A is a cross-sectional view of a loop antenna of the prior art.

FIG. 18B is a cross-sectional view of a loop antenna of the present invention partially enclosed in a twin coaxial cavity.

FIG. 19 is a pictorial representation of an inductor of the present invention with a spiral magnetic conductor strip.

FIG. 20 is a pictorial representation of a ground plane of the present invention.

FIG. 21 is a pictorial representation of a ground plane of the present invention illustrating a crosshatch mesh pattern.

FIG. 22 is a pictorial representation of a ground plane of the present invention illustrating a chicken wire mesh pattern.

DETAILED DESCRIPTION OF PREFERRED EMBODIMENTS

With reference to the figures where like elements have been given like numerical designations to facilitate an understanding of the present invention and particularly with reference to a first, relatively lower power, embodiment of the magnetic circuit of the present invention illustrated in FIG. 4, the magnetic circuit of the present invention may include one or more strips of a magnetic conductor 12 having submicron-sized cross-sections disposed adjacent an electrical conductor 14 with an insulative material 16 therebetween.

The submicron-size strips 12 have a thickness (t) of a few Angstroms (for example, about 4 to 10 Angstroms). The width (w) of each strip may be significantly less than the distance (d) between adjacent strips (for example, a width of about 2,000 to 4,000 Angstroms). The distance (d) and the number of strips (n) is determined for each specific application and may be optimized for a specific frequency range. The distance between strips (d) also may be established so that the magnetic field related to one of the strips has no substantial interaction with the magnetic field related to another one of the strips.

Each magnetic conductor strip 12 may be made of an amorphous magnetic material with high permeability, low magnetic reluctance, and relatively high electrical resistance. A material containing an alloy of iron, cobalt, and vanadium may be used, while materials containing alloys of iron, silicone and boron, or cobalt, silicon and boron, or cobalt, iron and silicon are also acceptable. It is desirable that the permeability of these materials be similar or better than that of crystalline permalloys and superalloys. Iron nickel alloys like Metglas TM 2826 MB, ($Fe_{40}$ 40 $Ni_{38}$ $Mo_4$ $B_{18}$) exhibit effective permeabilities of 50,000 at 1 kilohertz. Addition of cobalt as the major constituent increases the effective permeability to greater than 100,000. Alloys such as $Co_{70.5}$ $Fe_{4.5}$ $B_{10}$ $Si_{15}$ and $Co_{61.6}$ $Fe_{4.2}$ $Ni_{4.2}$ $B_2$ $Si_{10}$ exhibit permeabilities as high as 120,000.

In certain applications such as antennas, a ferromagnetic material may be used in the magnetic conductor strips. While it has heretofore been known that a ferromagnetic material is not desirable in a high frequency antenna, it has been shown in an antenna of the present invention that ferromagnetic strips are responsive up to several gigahertz. Eddy current losses are the primary reason for the failure of the ferromagnetic materials to be responsive at high frequencies. Eddy current losses decrease proportional to the square of the reduction of the magnetic path cross-sectional area. In other words, if the cross-sectional area is reduced by a factor of ten, eddy current losses will be reduced by a factor of one hundred. It is also known that eddy current losses increase with the square of the frequency. Thus, by using the submicron-size cross-section strips of the present invention, ferromagnetic materials in the magnetic conductor can be useful up to several gigahertz. As seen in FIG. 5, the frequency response of the present invention is a significant improvement over the frequency responses of traditional magnetic conductors such as solid and laminated metal and thin ribbons.

The submicron-size strips of magnetic conductor may be vacuum deposited and laser trimmed. Vacuum deposited strips provide a more amorphous magnetic conductor, that is less likely to crack and create gaps in the magnetic circuit than some other materials that may be used. Laser cutting may be used to trim the strips once they are deposited because it provides greater accuracy for submicron size strips. Photo-etching may also be used in applications where less accuracy is required.

In the first step of the laser trimming, traditional hot laser beams heat the material and provide rough cuts; that is, to dimensions not smaller than two- to three-thousandths of an inch. In the second step, a cool laser is used. Cool lasers may be pulse gas lasers with an output in the ultraviolet region of the spectrum. For example, an EXCIMER laser using krypton-fluoride lasing at 248 nanometers with an output power of 50 watts has been found to be acceptable. A cool laser removes and fine-trims the strips to meet the demanding submicron-size requirements. Cool lasers remove material through a nonthermal ablative process resulting in a high degree of precision with virtually none of the deleterious side effects of conventional hot laser processing. The cool laser controls line widths as well as controlling the ablation depth of the laser. Controlling the depth of the ablation is important because the magnetic material must be removed without damaging the insulator or electrical conductor.

An insulator 16 may be placed between the magnetic conductor strips 12 and the electrical conductor 14. The composition and configuration of the insulator is not critical to the present invention. The insulator, however, may have high dielectric strength, be able to prevent oxygen diffusion, and if the laser trimming process is to be used, be laser ablation resistant. If the strips 12 are to be vacuum deposited on the insulator, the insulator may be of a composition such that metal may be easily deposited thereon and once deposited have a high resistance to peeling. To this end, materials such as ACLAR TM, polyimide film, amorphous fluoropolymer film, such as TEFLON A.F., epoxy, diamond film, silicon dioxide, and ceramic base powders are acceptable.

The strips 12 on the entire structure may be covered with a conformal coating (not shown) which protects the strips 12 from corrosion and physical damage. Nonconductive materials such as those which may form the insulator, above, may be used for the coating. The coating may also be heat protecting, such as a heat reflective coating, and may be reinforced with a braid having strands of KEVLAR or KEVLAR-like fibers. Heat reflective coatings often contain metal reflective elements but in an insufficient amount to form an electromagnetic shield. Thus, the coating can reflect heat but not substantially interfere with the use of the coated device as an antenna.

The electrical conductor 14 may include any known electrical conductor having low resistance such as copper or silver. The composition and configuration of the material depends on the specific application. The electrical conductor may take any shape, including without limitation, a solid wire, a tube, a deposited film or a thin multistranded layer supported by a carrying structure. With reference to FIG. 6, a multistranded electrical conductor 14 may provide flexibility to an antenna embodying the present invention. Each strand may be electrically insulated from the adjacent strands, except where it is operatively connected to the antenna's circuitry.

The electrical conductor 14 may also be a high or low electrical superconductor. For applications in antennas, the superconductor may be fabricated by depositing a thick film of ink containing $Y\,Ba_2Cu_3O_7$ onto a low loss ceramic substrate or may be deposited in a thin film of yttrium-barium-copper oxide by an appropriate laser beam vapor deposition technique. A matching network may be provided to match the impedance of the electrical conductor of the antenna to the impedance of the transmission line. The antenna and impedance matching network may then be enclosed within a single closed cycle liquid nitrogen cryostat.

As was mentioned earlier, the present invention is particularly suited for use in antennas. It is known that antenna elements one-quarter to one-half wavelength long generally provide the best gain in efficiency. The physical length of the antenna may be reduced by conventional ferrite or dielectric loading techniques. These methods, however, limit the shortening to a factor of five or six. By using the present invention to increase the inductivity of the electrical conductor in an antenna, the physical length of the antenna may be shortened by a factor of ten or more. In the present invention, the inductivity of the electrical conductor may be increased by increasing the density of the magnetic conductor strips 12 on the electrical conductor. For example, the density may be varied by varying the number (n) of magnetic conductor strips, the distance (d) between strips and, the width (w) and thickness (t) of the strips.

The inductivity of the electrical conductor may also be varied by stacking the magnetic conductor strips 12. With reference to FIGS. 7A–C, wherein an electrical conductor 14 and strips 12 are shown in cross-section, the inductivity may be varied linearly by uniformly spacing apart single strips 12 (FIG. 7A). The inductivity may be varied progressively by providing stacks of strips 12 of increasing height that are uniformly spaced (FIG. 7B). The inductivity variation may be both nonlinear and progressive when the electrical conductor is provided with stacked strips of increasing height that have nonuniform spacing (FIG. 7C).

When the present invention is to operate at relatively high power with frequencies lower than several gigahertz (e.g., at a kilohertz) the submicron-size magnetic conductor may no longer be optimal. Magnetic conductors having a larger cross-section, such as microwire having a diameter up to about 100 microns, may be used to form the magnetic circuit.

The present invention may be applicable in a variety of antenna applications. The embodiments of the present invention which follow are merely exemplary of those applications. As seen in FIG. 8, the closed form of the present invention may be employed in a monopole antenna or as an inductive wire that is part of an antenna system. Magnetic conductor strips 12 having a width (w) and a thickness (t) may be spaced apart at distance (d) on an insulator 16 overlying an electrical conductor 14. The electrical conductor may be deposited on a supporting structure 20 such as KEVLAR TM epoxy. In such an antenna, the distance (d) between strips may be very much less than the wavelength of the electromagnetic wave and the strip width (w) may be much less than the distance (d).

Plural monopole antenna embodiments or the present invention may be combined to form a multistranded cable antenna, as shown in cross-section in FIG. 9. The strands may be twisted (not shown) and insulated from each other with appropriate insulative material. This embodiment may have application in large bandwidth antennae.

Another embodiment of the closed form of the magnetic circuit of the present invention may be seen in the dipole antenna depicted in FIG. 10. Each pole of the antenna may include plural magnetic conductor strips 12 at the most spaced apart ends of the electrical conductors 14. Appropriate electrical leads 30 may be provided. The poles of the antenna may take various forms, such as those shown in FIGS. 6 and 8 and stacked such as shown in FIG. 7.

With reference now to FIGS. 11 through 15, various embodiments of the open circuit version of the present invention are disclosed. The method of manufacture of such antennas is shown in FIG. 11. A strip of insulation 16 such as polyimide may be provided (drawing A of FIG. 11) and a film of magnetic conductor may be deposited thereon (drawing B). Magnetic conductor strips 12 may be formed from the film using processes discussed herein (drawing C). The electrical conductor 14 may be provided (drawing D) and arrayed about the insulator 16 and strips 12 (drawing E). The strips 12 may be grouped in patterns, with each pattern having its own electrical conductor 14, to form a multiple antennae array. Each electric 1 conductor 14 may be provided with a separate electrical connection (not shown). Using this technique, various embodiments of the present invention may be provided to obtain electromagnetic sensors such as a single loop antenna (FIG. 11E), a multiple loop antenna (FIG. 12), a sensing twin loop antenna (FIG. 13), a 360° sensing triplet (FIG. 14), and a direction finding "Y" array (FIG. 15). Appropriate sensing means 41 (FIG. 12) may be provided to detect the electrical current formed in each electrical conductor when the strips are in the presence of electromagnetic waves. Multiple antennae arrays may be used for direction finding by using the phase and amplitude relationships of inputs from each antenna.

Another embodiment of the present invention is a spiral antenna shown in exploded form in FIG. 16. Magnetic conductor strips 12 may be deposited in a radial pattern above and below the electrical conductor spiral 14. One or more interlocking spirals of electrical conductor 14 may be provided so as to coordinate the density of the electrical conductor and the magnetic conductor and provide the correct frequency response for the antenna. Appropriate supporting structure 20 may also be provided, which may include a tuned cavity 22.

When used with a printed circuit board the present invention may take the form of a sandwich, as seen in cross section in FIGS. 17A-B, with magnetic conductor strips 12 deposited on both sides of the board 42 about an electrical conductor 14 to provide a nearly unbroken magnetic circuit. The strips 12 may be deposited using the method discussed in relation to FIG. 11 or may comprise suitably affixed microwire.

With reference to FIGS. 18A-B, the present invention may have application in a loop antenna 34 partially enclosed in twin coaxial cavities 36 shown in cross-section. The addition of the magnetic conductors 12 to the loop antenna 34 of the prior art (FIG. 18A) provides for the size reduction of, both the antenna 34 and the cavity 36 (FIG. 18B). The ground plane 38 forming the cavity 36 may be connected to an appropriate electrical connection such as a coaxial line 40.

In addition to applications in antennas, the present invention may have application in numerous other devices. For example, the present invention may be used to create a simple inductor out of a single strand of wire. See, for example, FIG. 2 in which one or more strips 12 may be disposed about a core 14. Also, as seen in FIG. 19, a single strip 12 may be wound around a core 14 which may be hollow. The winding may be in the form of a spiral, which may close on itself or be open, or may have an even spacing between turns as depicted in FIG. 19, or with variable spacing to meed specific applications. Plural windings may also be used. The magnetic conductor may also be wound about the electrical conductor so that portions of the magnetic conductor overlap, such as when winding magnetically conductive microwire about an electrical conductor.

As seen in FIG. 20, the present invention may have application in a ground plane for an antenna to miniaturize the ground plane in a manner similar to the antenna miniaturization discussed above. For example, electrical conductors and magnetic conductors may be arrayed in the ground about an antenna 32 in an appropriate mesh or separated pattern, such as the crosshatch mesh illustrated in FIG. 21 or the chicken wire mesh illustrated in FIG. 22. The strips and/or conductors may be overlaid with a protective layer (not shown), such as a conformal coating, or be placed between two protective liners (not shown) that may be porous for drainage.

The present invention may have further application in a magnetic sensor. See, for example, FIGS. 3 and 11-15.

While preferred embodiments of the present invention have been described, it is to be understood that the embodiments described are illustrative only and that the scope of the invention is to be defined solely by the appended claims when accorded a full range of equivalence, many variations and modifications naturally occurring to those skilled in the art from a perusal hereof.

I claim:

1. A circuit comprising:
(a) an electrical conductor;
(b) plural microscopic strips of high permeability magnetic conductor disposed in a proximate relationship to said electrical conductor, said strips being juxtaposed at predetermined intervals; and
(c) an insulator disposed between said electrical conductor and said strips.

2. The circuit as defined in claim 1 wherein said strips are electrically insulated from each other.

3. The circuit as defined in claim 1 wherein said insulator comprises a material selected from the group consisting of polyimide film, amorphous fluoropolymer film, epoxy, diamond film, silicon dioxide, and ceramic based powder.

4. The circuit as defined in claim 1 wherein said magnetic conductor comprises an alloy selected from the group consisting of: (a) iron, cobalt, and vanadium; (b) iron, silicon, and boron; (c) cobalt, silicon, and boron; and (d) cobalt, iron, silicon.

5. The circuit as defined in claim 1 wherein said magnetic conductor comprises a ferromagnetic material.

6. The circuit as defined in claim 1 wherein said electrical conductor comprises plural electrically conductive and operatively connected elements substantially insulated from each other.

7. The circuit as defined in claim 6 wherein said elements are insulated from each other over most of their length.

8. The circuit as defined in claim 1 wherein each of said strips forms a magnetic path around said electrical conductor.

9. The circuit as defined in claim 8 wherein each said magnetic path is substantially unbroken and follows the shortest route around said electrical conductor.

10. The circuit as defined in claim 1 wherein said strips are linear and spaced apart from each other.

11. A circuit comprising:
(a) an electrical conductor; and
(b) plural strips of high permeability magnetic conductor juxtaposed at predetermined intervals in a proximate relationship to said electrical conductor, each of said strips having a small size so that the permeability of each of said strips is relatively constant when electromagnetic waves are present, and
each of said strips having a submicron cross-sectional width and thickness and follows the relatively shortest path around said electrical conductor.

12. The circuit as defined in claim 11 wherein said cross-sectional thickness is approximately between two and ten Angstroms.

13. The circuit as defined in claim 12 wherein said cross-sectional width is approximately one-third of a micron.

14. The circuit as defined in claim 11 wherein each of said strips comprises microwire.

15. The circuit as defined in claim 11 wherein said magnetic conductor comprises a ferromagnetic material.

16. The circuit a defined in claim 11 wherein the frequencies of said electromagnetic waves range from about a kilohertz to several gigahertz.

17. The circuit as defined in claim 16 wherein said frequencies range from 2 kilohertz to 2 gigahertz.

18. In a circuit having an electrical conductor for carrying an alternating current, a method of decreasing the natural reluctance of a magnetic field surrounding said electrical conductor comprising the steps of:

(a) providing plural microscopic strips of high permeability metallic magnetic conductor; and (b) juxtaposing said strips in a proximate relation to said electrical conductor at predetermined intervals, each of said strips forming an unbroken band following the relatively shortest path around said electrical conductor.

19. The method as defined in claim 18 wherein said strips are linear and spaced apart from each other.

20. An antenna comprising:

(a) an electrical conductor;

(b) plural microscopic strips of high permeability metallic magnetic conductor disposed in a proximate relationship to said electrical conductor at predetermined intervals; and (c) an insulator disposed between said electrical conductor and said strips.

21. The antenna as defined in claim 20 wherein said electrical conductor comprises multiple strands insulated from each other.

22. The antenna as defined in claim 20 wherein each of said strips comprises a submicron sized layer of said magnetic conductor.

23. The antenna as defined in claim 20 wherein each of said strips comprises a microwire.

24. An antenna comprising:

(a) an electrical conductor;

(b) plural bands of high permeability metallic magnetic conductor carried at predetermined intervals by said electrical conductor, each of said bands having a microscopic cross-sectional size so that the permeability of said magnetic conductor remains relatively constant in the presence of electromagnetic waves having frequencies between about a kilohertz and about several gigahertz; and (c) an insulator disposed between said electrical conductor and said bands.

25. The antenna as defined in claim 24 wherein said cross-sectional size is approximately between two and ten Angstroms thick and approximately between 2,000 and 4,000 Angstroms wide.

26. The antenna as defined in claim 25 wherein said cross-sectional size is a diameter of up to approximately one hundred microns.

27. The antenna as defined in claim 24 wherein said electrical conductor comprises a superconductor.

28. An antenna comprising:

(a) an electrical conductor;

(b) an insulator carried around said electrical conductor; and (c) plural microscopic strips of high permeability magnetic conductor carried by said insulator at predetermined intervals so that said strips encircle said electrical conductor.

29. The antenna as defined in claim 28 wherein said antenna is a dipole antenna and said strips are arrayed adjacent the distal ends of said electrical conductor.

30. The antenna as defined in claim 28 further comprising a conformal coating overlaying said strips to protect said strips from deteriorations.

31. An antenna comprising:

(a) an electrical conductor; and (b) plural microscopic bands of high permeability magnetic conductor disposed in a proximate relation to said electrical conductor, groups of said bands being disposed in predetermined increments of said electrical conductor for creating multiplication factors of the self-inductance of said predetermined increments so that the self-inductance for each of said increments is established.

32. The antenna as defined inc claim 31 wherein the number of said bands in each of said groups is not the same so that said multiplication factors are nonlinear.

33. A device for simultaneously increasing the electrical conductivity and the inductivity of an antenna comprising:

(a) an electrical superconductor;

(b) plural bands of high permeability metallic magnetic conductor disposed in a proximate relationship to said electrical superconductor at predetermined intervals for forming magnetic paths around said electrical superconductor, each of said bands having a microscopic cross-section and following the relatively shortest path around said electrical superconductor; and (c) an insulator disposed between said electrical superconductor and said bands.

34. A spiral antenna comprising:

(a) an electrical conductor arrayed in at least one spiral; and (b) plural radially arrayed submicron-size strips of high permeability magnetic conductor disposed in a proximate relation to said spiral.

35. The spiral antenna as defined in claim 34 wherein said electrical conductor has a greater cross-sectional area at its radially outward portion than at its center.

36. The spiral antenna as defined in claim 34 wherein the number of said strips of said magnetic conductor per unit length of said electrical conductor is greater at said radially outward portion of said electrical conductor than at its center.

37. The spiral antenna as defined in claim 36 wherein said electrical conductor has a constant cross-sectional area.

38. The spiral antenna as defined in claim 34 wherein said electrical conductor has a constant cross-sectional area.

39. A monopole antenna comprising:

(a) a core for carrying said antenna;

(b) an electrical conductor overlying said core;

(c) plural microscopic bands of high permeability magnetic conductor disposed in a proximate relationship to said electrical conductor at predetermined intervals; and (d) an insulator disposed between said plural strips and said electrical conductor.

40. A dipole antenna comprising:

(a) two electrical conductors forming the poles of said dipole antenna, said electrical conductors being electrically insulated from each other; and (b) plural microscopic strips of high permeability magnetic conductor disposed in a proximate relationship to said electrical conductors so that said strips form magnetic circuits about said electrical conductors.

41. A loop antenna comprising:

(a) plural coplanar microscopic strips of high permeability magnetic conductor, said strips being generally parallel and spaced a predetermined distance apart;

(b) an electrical conductor disposed in a proximate relationship to and encircling said strips; and (c) an insulator disposed between said strips and said conductor.

42. The antenna as defined in claim 41 wherein said electrical conductor encircles said strips at least two times.

43. A method for making an electromagnetic sensor for sensing electromagnetic waves comprising the steps of:

(a) arraying plural microscopic strips of high permeability magnetic conductor on an insulative substrate;

(b) positioning at least one electrical conductor about said substrate so that each said electrical conductor substantially surrounds a plurality of said strips; and (c) providing means for sensing the electrical current formed in each of said electrical conductor.

44. The method as defined in claim 43 wherein said strips are arrayed in two generally perpendicular patterns.

45. The method as defined in claim 43 wherein said strips are arrayed in three patterns to form a triangle.

46. The method as defined in claim 43 wherein said strips are arrayed in two patterns to form a Y-shape.

47. An electromagnetic sensor comprising:

(a) an insulative substrate;

(b) plural microscopic strips of high permeability magnetic conductor, said strips being arrayed on said substrate to form at least one pattern of generally parallel strips;

(c) at least one electrical conductor positioned about said substrate so that each said electrical conductor generally surrounds one said pattern; and (d) means for sensing the electrical current in said electrical conductor.

48. The sensor as defined in claim 47 comprising two generally perpendicular said patterns.

49. The sensor as defined in claim 47 comprising two said patterns generally forming a Y-shape.

50. The sensor as defined in claim 47 comprising three said patterns generally forming a triangle.

51. A method of sensing electromagnetic waves comprising the steps of:

(a) arraying plural microscopic strips of high permeability magnetic conductor on an insulative substrate;

(b) positioning an electrical conductor about said substrate so that said electrical conductor substantially surrounds a plurality of said strips to form at least one complete turn; and (c) sensing the electrical current formed in said electrical conductor by said strips when said strips are in the presence of electromagnetic waves.

52. A multi-stranded cable antenna comprising:

(a) a core for carrying plural monopole antenna strands; and (b) plural monopole antenna strands, each comprising, an electrical conductor, and plural microscopic bands of high permeability magnetic conductor disposed in a proximate relationship to said electrical conductor at predetermined intervals, said electrical conductors being electrically insulated from each other over most of their length.

53. The antenna as defined in claim 52 wherein each of said electrical conductor comprises plural lengthwise strips that are electrically insulated from each other over most of their length.

54. A ground plane for an antenna comprising:

(a) plural electrical conductors arrayed about the base of an antenna; and (b) plural microscopic strips of high permeability magnetic conductor disposed in a proximate relationship to each of said electrical conductors at predetermined intervals.

55. The ground plane as defined in claim 54 further comprising a conformal coating overlaying said strips and said electrical conductors to provide protection from damage.

56. The ground plane as defined in claim 55 wherein said conformal coating comprises a reinforcing braid.

57. The ground plane as defined in claim 56 wherein said braid comprises non-metallic fibers.

58. The ground plane as defined in claim 54 further comprising two protective liners for protecting said strips and said electrical conductors placed therebetween.

59. The ground plane as defined in claim 58 wherein said liners are perforated for drainage.

60. The ground plane as defined in claim 54 wherein said electrical conductors and said strips are arrayed in a meshed pattern.

61. The ground plane as defined in claim 60 further comprising a conformal coating overlaying said strips and said electrical conductors to provide protection from damage.

62. The ground plane as defined in claim 61 wherein said conformal coating comprises a reinforcing braid.

63. The ground plane as defined in claim 62 wherein said braid comprises non-metallic fibers.

64. The ground plane as defined in claim 60 further comprising two protective liners for protecting said strips and said electrical conductors placed therebetween.

65. The ground plane as defined in claim 64 wherein said liners are perforated for drainage.

66. A magnetic sensor comprising:

(a) plural coplanar microscopic strips of high permeability magnetic conductor, said strips being generally parallel and spaced a predetermined distance apart; and (b) at least one electrical conductor disposed in a proximate relationship to and encircling said strips, whereby an electrical signal is formed in each said electrical conductor when said strips are subjected to a magnetic field, said strips being arrayed in plural patterns in predetermined angular relationships, one said electrical conductor for each of said patterns.

67. An inductor comprising:

(a) an electrically conductive core;-and (b) at least one microscopic strip of high permeability magnetic conductor disposed in a proximate relationship to said electrically conductive core at predetermined intervals for increasing the natural inductivity of said core, said strip comprising submicron sized layers.

68. The inductor as defined in claim 67 further comprising a conformal coating overlaying said strip and said core to provide protection from damage.

69. The inductor as defined in claim 68 wherein said conformal coating comprises a reinforcing braid.

70. The inductor as defined in claim 69 wherein said braid comprises non-metallic fiber.

71. The inductor as defined in claim 67 wherein said core is hollow.

72. The inductor as defined in claim 67 wherein said core further comprises a nonelectrically conductive portion underlying an electrically conductive portion.

73. The inductor as defined in claim 67 wherein said strip comprises microwire.

74. The inductor as defined in claim 67 wherein at least one said strip spirals around said core.

75. The inductor as defined in claim 74 comprising more than one said strip and wherein said strips overlap.

76. An antenna comprising:

(a) electrical conductor having two distal ends;

(b) a ground plane having two cavities, each adapted to receive one of said distal ends; and (c) plural microscopic strips of high permeability magnetic conductor disposed in a proximate relationship to said electrical conductor.

77. The antenna as defined in claim 76 wherein said strips are carried by said electrical conductor within said cavities.

78. An antenna comprising:

an electrically conductive core adapted to create a magnetic field thereabout; and plural strips of high permeability, magnetically conductive and electrically resistive material positioned in a proximate relationship to said core for forming paths for said magnetic field.

79. The antenna as defined in claim 78 wherein each of said strips forms a continuous band around said core.

80. The antenna as defined in claim 79 wherein each of said strips has a maximum cross-sectional dimension of approximately one hundred microns.

81. The antenna as defined in claim 80 wherein each of said strips has a maximum cross-sectional dimension of less than one micron.

82. An antenna comprising:

an electrically conductive core adapted to create a magnetic field thereabout; and plural strips of high permeability, magnetically conductive and electrically resistive material, each of said strips spiraling around said core so that said strips overlap and form paths for said magnetic field.

83. An antenna comprising:

plural strips of high permeability, magnetically conductive and electrically resistive material arrayed generally parallel on a substrate for sensing the presence of a magnetic field; and an electrical conductor proximate said strips for providing a signal when said strips sense the magnetic field.

* * * * *